United States Patent [19]

Arikawa et al.

[11] Patent Number: 4,467,308

[45] Date of Patent: Aug. 21, 1984

[54] FUSE ASSEMBLY

[75] Inventors: Hiroo Arikawa, Tokyo; Akira Taniguchi, Yokohama, both of Japan

[73] Assignee: San-o Industrial Co., Ltd., Tokyo, Japan

[21] Appl. No.: 226,370

[22] Filed: Jan. 19, 1981

Related U.S. Application Data

[63] Continuation-in-part of Ser. No. 884,595, Mar. 8, 1978, , which is a continuation-in-part of Ser. No. 732,183, Oct. 13, 1976, abandoned.

[51] Int. Cl.[3] ..... H01H 85/16

[52] U.S. Cl. ..... 337/231; 337/246; 337/252

[58] Field of Search ..... 337/231, 232, 234, 236, 337/246, 248, 251, 252, 295

[56] References Cited

U.S. PATENT DOCUMENTS 2,222,291 11/1940 Freeman et al. ..... 337/112 X 3,094,600 6/1963 Kozacka ..... 337/232

*Primary Examiner*—George Harris

[57] ABSTRACT

An improved fuse assembly having a unique structure comprising a rigid tubular member having preformed solder-receiving recesses on its outer surface at each end of the tubular member. A fusible element is stretched between the ends of the tubular member and a preformed notch on the rim at each end of the tubular member serves to pick up each end of the fusible element and bent thereover for embedding it into the preformed outer recesses of the tubular member.

1 Claim, 4 Drawing Figures

FUSE ASSEMBLY

RELATED APPLICATIONS

This invention is a continuation-in-part of application Ser. No. 884,595 filed Mar. 8, 1978 which is, in turn, a continuation-in-part of application Ser. No. 732,183, filed Oct. 13, 1976, now abandoned.

FIELD OF INVENTION

This invention relates to a fuse assembly and is particularly related to a fuse assembly of novel construction and configuration.

BACKGROUND OF INVENTION

In fuse assemblies with conventional construction, a fusible element is stretched diagonally between the ends of a tubular member such as a cartridge, and the ends of the fusible elements are soldered at both ends of the tube which is capped with a ferrule or a similar means. In the construction of some fuse assemblies, the ends of the fusible element are bent over the outside surface of the tube before capping the ends with the ferrule, metal cap or the like. This construction requires that a suitable gap be provided between the ferrule (or cap) and the ends of the tube. Fuse assemblies with such construction, however, have several drawbacks. Thus, if a fuse element with a relatively large cross sectional area is used, it becomes difficult to fit the ferrule or the cap at the ends of the tube. On the other hand, if the cross sectional area of the fuse is relatively small, the ferrule or cap will have a tendency to be displaced eccentrically relative to the axis of the tube. Additionally, an inclination of the cap will result from this arrangement making it difficult to install the fuse assembly into a fuse-holder. Moreover, the fusible element will be subjected to compression between the ends of the tube and the inside surface of the caps thereby resulting in deformation of the fusible element and/or its rupture.

In some conventional fuses, there is also a large clearance between the ends of the tube and the inside of the end caps or ferrules. This generally results in poor electrical connection and inferior performance.

In U.S. Pat. No. 3,094,600 which issued to Frederick J. Kozacka on June 18, 1963, an improved cartridge fuse is disclosed which comprises solder joints between the caps or ferrules and the ends of fusible element wherein the solder joints are situated inside of the fuse. As shown more specifically in FIGS. 3 and 4 of Kozacka, the solidified solder pool has projections 5a, 5a which extend in a direction longitudinally of casing 2 into gaps G formed between casing 2 and the end caps 6,6. Col. 2, ls 43–46. This construction, however, does not overcome the difficulties and disadvantages hereinbefore discussed connection with the prior art fuses.

Accordingly, it is an object of this invention to provide an improved fuse assembly.

It is a further object of this invention to provide a fuse assembly which, due to its novel and unique construction, is free from the foregoing disadvantages and limitations.

It is another object of this invention to provide a fuse assembly comprising fuse elements of large or small cross sectional areas without displacement or difficulty in installation.

It is still another object of this invention to provide a fuse assembly with such improved construction without adversely effecting its performance characteristic or breaking capacity.

The foregoing and other objects of this invention will be more fully described in the following detailed description of the invention taken in conjunction with the accompanying drawings.

SUMMARY OF INVENTION

A fuse assembly is provided which is designed to overcome some of the problems inherent in fuse construction such as, e.g., eccentric displacement of the end caps, deformation of fusible element due to end compressions, excessive clearance between the ends of the tubular element and the end caps, excessive use of solder, etc.

The fuse assembly comprises a rigid (e.g., glass) tube or cartridge having preformed solder-receiving wells or recesses on its outer surfaces. A fusible element is stretched between the ends of the tubular member and a preformed notch in the rim at each end of the tubular member serves to securely engage the ends of the fusible elements for bending thereover and into the outer recesses wherein they are secured by solder.

Each of the recesses may further include a laterally extending groove in which the respective ends of the fusible element may be embedded and secured.

The rigid tubular member is tightly capped at both ends by closure means such as, e.g., ferrules to complete the structure of the fuse assembly while insuring reliable electrical connection and structural integrity.

BRIEF DESCRIPTION OF DRAWINGS

In the drawings, where like reference numerals are employed to designate like parts.

DETAILED DESCRIPTION OF INVENTION

Figure 1:
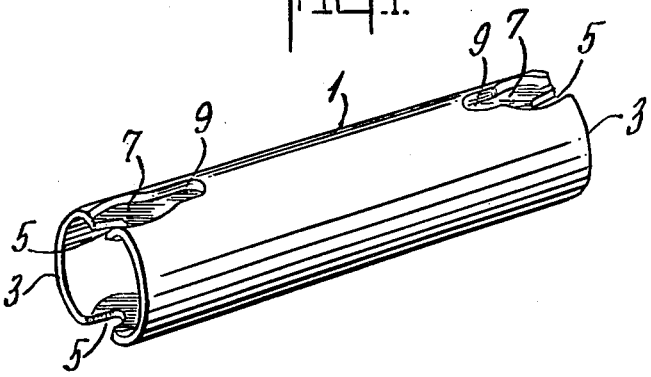
FIG. 1 is a perspective view of a tubular member used in the construction of the fuse assembly of this invention illustrating the provision of the notched ends, the recessed outer surfaces and their respective lateral grooves.
Figure 2:
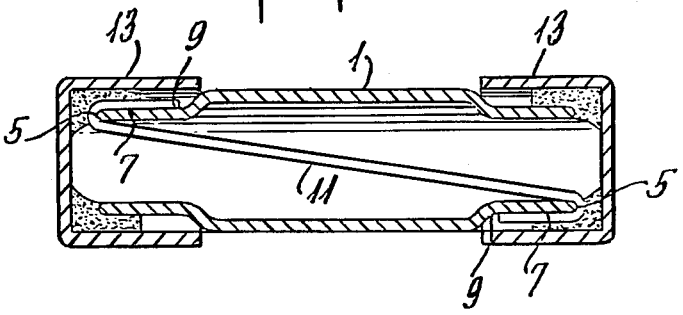
FIG. 2 is a side, sectional view of the fuse assembly of this invention.
Figure 3:
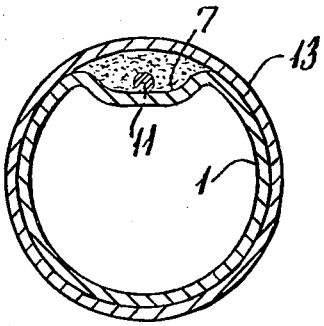
FIG. 3 is an end view looking at either end of the tubular member shown in FIG. 1.

Referring now to the drawings, and with particular reference first to FIGS. 1 and 2, there is shown a rigid tubular member or cartridge 1 (e.g., glass) whose end 3,3 are performed with notches 5,5. These notches may be formed at both ends or at diagonally opposed ends of the tubular member, and they serve an important function in the construction of the fuse assembly.

The outer surface of the tubular member 1 at the ends 3,3, there are provided with preformed, recessed, solder-receiving areas 7,7 each having a laterally extending groove 9. The recessed areas 7,7 with their laterally extending grooves 9,9 may be conveniently formed at diagonally opposed ends of the tubular member.

A fusible element 11 (e.g., wire) of suitable length is stretched diagonally between the ends of the tubular member and the end portions of the fusible elements are picked up by the preformed notch at each end, bent thereover and passed through or embedded in the preformed solder-receiving areas 7,7 and secured in the respective grooves 9,9. After filling the solder-receiving areas 7,7 with solder, the ends 3,3 are pressure fitted with end caps 13,13 to complete the construction of the fuse assembly.

Figure 4:
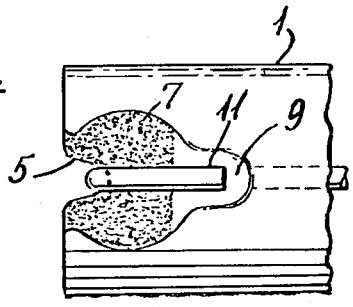
FIG. 4 is a top view of the outer surface of the tubular member near the end thereof illustrating the manner in which each end of the fusible element is secured.

The preformed solder-receiving areas 7,7 serve as a pool of solder for insuring electrical contact between the fusible element therein. The solder-receiving areas 7,7 are generally round shaped because round-shaped solder connected to the end caps with the ends of the fusible element 11 secured as aforesaid, can better withstand the axial pull and the rotating forces exerted thereon. (See FIG. 4). Additionally, the grooves 9,9 serve to firmly secure the ends of the fusible element 11 so that there is little or no tendency to displacement or rupture.

A fuse assembly constructed as hereinbefore described permits pressure fitting of the end caps with relatively constant clearance regardless of the cross-sectional size of the fusible element. It eliminates the problem of eccentricity or difficulties of installation in fuseholders which were encountered with prior art type fuse assemblies.

While the fuse assembly of this invention was heretofore described with a certain degree of particularity, it is understood that such description is not intended to limit the scope of this invention. Numerous changes and/or modifications are suggested from the foregoing detailed description which are encompassed within the disclosure herein.

What is claimed is:

1. A fuse assembly comprising a rigid tubular member having rims at its opposite ends wherein each of said rims has; a preformed generally gourd-shaped recessed area defined by a notch and a groove disposed on the exterior surface of said rigid tubular member at each end thereof; a fusible element stretched between the ends of said rigid tubular member, the ends of said fusible element being securely positioned within said respective preformed notches and bent thereover to the exterior surface of said rigid tubular member and embedded into said grooves of said generally gourd-shaped recess and secured therein by solder, and end caps enclosing the ends of said tubular member and said recesses.

* * * * *